US007624590B2

(12) United States Patent
Choi et al.

(10) Patent No.: US 7,624,590 B2
(45) Date of Patent: Dec. 1, 2009

(54) MULTI-TYPE AIR CONDITIONER

(75) Inventors: Jae Heuk Choi, Seoul (KR); Hyung Soo Kim, Seoul (KR); Yoon Beon Lee, Seoul (KR); Baik Young Chung, Incheon (KR); Se Dong Chang, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 11/254,664

(22) Filed: Oct. 21, 2005

(65) Prior Publication Data

US 2006/0090486 A1 May 4, 2006

(30) Foreign Application Priority Data

Nov. 3, 2004 (KR) ..... 10-2004-0088949

(51) Int. Cl.
*F25B 13/00* (2006.01)

(52) U.S. Cl. ..... 62/324.1

(58) Field of Classification Search ..... 62/83, 62/198, 324.1–324.2, 324.4, 324.6, 419, 62/503, 513
See application file for complete search history.

(56) References Cited

U.S. PATENT DOCUMENTS 2,472,729 A * 6/1949 Sidell ..... 62/83
3,065,610 A * 11/1962 Maudlin ..... 62/149
3,783,841 A * 1/1974 Hirschler et al. ..... 123/576
3,950,961 A * 4/1976 Lotz ..... 62/149
3,955,375 A * 5/1976 Schumacher ..... 62/217
4,030,315 A * 6/1977 Harnish ..... 62/324.4
4,217,765 A * 8/1980 Ecker ..... 62/503
4,488,413 A * 12/1984 Bottum ..... 62/503
4,718,250 A * 1/1988 Warren ..... 62/278
5,233,842 A * 8/1993 Manning et al. ..... 62/132
5,245,833 A * 9/1993 Mei et al. ..... 62/113
5,622,055 A * 4/1997 Mei et al. ..... 62/113
5,878,810 A * 3/1999 Saito et al. ..... 165/240
6,220,050 B1 * 4/2001 Cooksey ..... 62/503
6,276,158 B1 * 8/2001 Lowes et al. ..... 62/324.5
6,449,980 B1 * 9/2002 Minister ..... 62/513
2003/0089493 A1 * 5/2003 Takano et al. ..... 165/202

(Continued)

FOREIGN PATENT DOCUMENTS

JP 7-120092 A 5/1995

*Primary Examiner*—Melvin Jones
(74) *Attorney, Agent, or Firm*—Birch, Stewart, Kolasch & Birch, LLP

(57) ABSTRACT

A multi-type air conditioner includes an outdoor unit, one or more indoor units communicating with the outdoor unit, and a liquid-stay preventing device heating and evaporating a liquefied refrigerant so as to prevent the liquefied refrigerant circulating between the indoor unit and the outdoor unit from being accumulated at a low pressure side including the indoor unit. Accordingly, a liquefied refrigerant is not accumulated in an indoor unit and a connection pipe, which are a low pressure side where the pressure is relatively low, but smoothly passes therethrough regardless of a height difference between the indoor unit and the outdoor unit. Therefore, the efficiency of the multi-type air conditioner is improved. Also, because the refrigerant deficiency is prevented from occurring at a high pressure side, the reliability of the cooling operation is improved, and the liquefied refrigerant accumulated at the low pressure side is introduced into a compressor of the outdoor unit, thereby preventing damage to the compressor.

14 Claims, 5 Drawing Sheets

U.S. PATENT DOCUMENTS

2004/0123612 A1* 7/2004 Pham et al. ..... 62/228.3
2005/0066671 A1* 3/2005 Srichai et al. ..... 62/160
2005/0120733 A1* 6/2005 Healy et al. ..... 62/324.4
2005/0204766 A1* 9/2005 Sasaki ..... 62/259.2
2006/0174639 A1* 8/2006 Lee et al. ..... 62/160

* cited by examiner

MULTI-TYPE AIR CONDITIONER

BACKGROUND OF THE INVENTION

1. Field of the Invention

The present invention relates to an air conditioner, and particularly, to a multi-type air conditioner provided with a plurality of indoor units capable of cooling or heating each indoor space.

2. Description of the Background Art

In general, an air conditioner is an apparatus that can control the temperature, humidity, current and cleanness of the air for the purpose of making a pleasant indoor environment.

According to a configuration of units, the air conditioner is divided into an integration type air conditioner in which both an indoor unit and an outdoor unit are received in a single case, and a separation type air conditioner in which a compressor and a condenser are constructed as an outdoor unit and an evaporator is constructed as an indoor unit. Here, some of the air conditioners can selectively perform cooling and heating by switching a flow path of a refrigerant using a flow path switching valve.

Recently, a multi-type air conditioner having a plurality of indoor units for the purpose of cooling or heating each space is being increasingly used.

FIG. 1 is a schematic view of a conventional multi-type air conditioner. Referring to FIG. 1, the multi-type air conditioner 10 includes a plurality of indoor units 110, an outdoor unit 120 providing a compressed refrigerant to the indoor units 110, and a connection pipe 130 connecting the indoor units 110 with the outdoor unit 120.

The outdoor unit 120 is commonly installed on the top of a building, and each indoor unit 110 is installed in each room and on each floor. Thus, a height difference as high as H exists between the indoor units 110 and the outdoor unit 120, and a length (L) of the connection pipe 130 connecting the indoor unit 110 to the outdoor unit 120 becomes long, which makes return pressure of the liquefied refrigerant to the outdoor unit insufficient.

Thus, the liquefied refrigerant cannot return to the outdoor unit 120, a high pressure side, but is accumulated in the indoor units 110 and the connection pipe 130, a low pressure side. Particularly, such a phenomenon gets worse when the multi-type compressor is in a low-load operation mode where only some of the indoor units 110 are operated.

Consequently, refrigerant deficiency occurs at the high pressure side, which contributes to degrading reliability of cooling operation, and the liquefied refrigerant accumulated at the low pressure side may be introduced to a compressor (not shown) of the outdoor unit 120 and cause damage to the compressor.

SUMMARY OF THE INVENTION

Therefore, an object of the present invention is to provide a multi-type air conditioner in which a liquefied refrigerant can smoothly pass through a low pressure side without being accumulated therein regardless of a height difference between an outdoor unit and indoor units.

To achieve these and other advantages and in accordance with the purpose of the present invention, as embodied and broadly described herein, there is provided a multi-type air conditioner comprising: an outdoor unit; one or more indoor units communicating with the outdoor unit; and a liquid-stay preventing device heating and evaporating a liquefied refrigerant so as to prevent the liquefied refrigerant circulating between the indoor unit and the outdoor unit from being accumulated at a low pressure side including the indoor unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
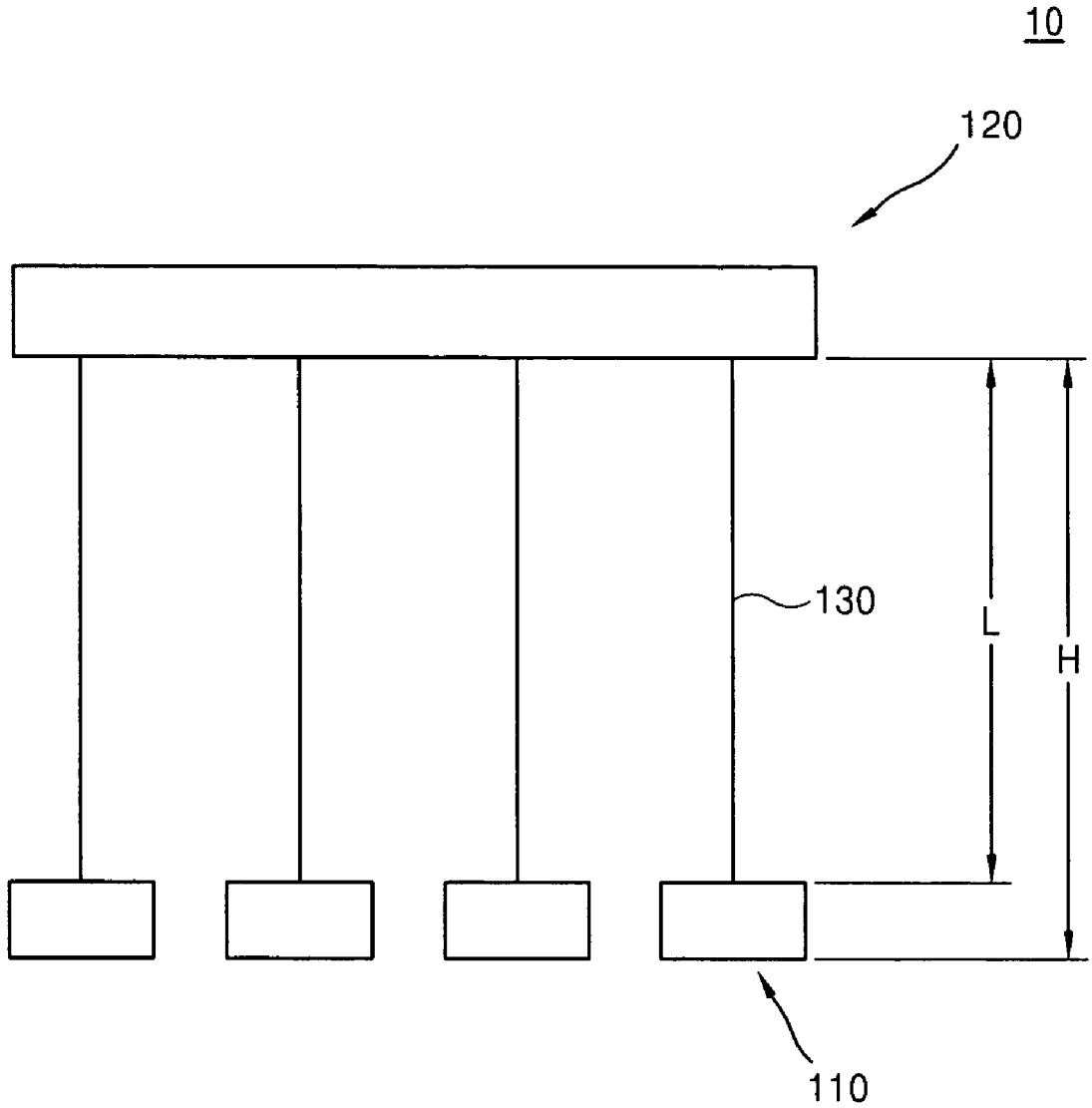
FIG. 1 CONVENTIONAL ART
FIG. 1 is a schematic view of a conventional multi-type air conditioner.
Figure 2:
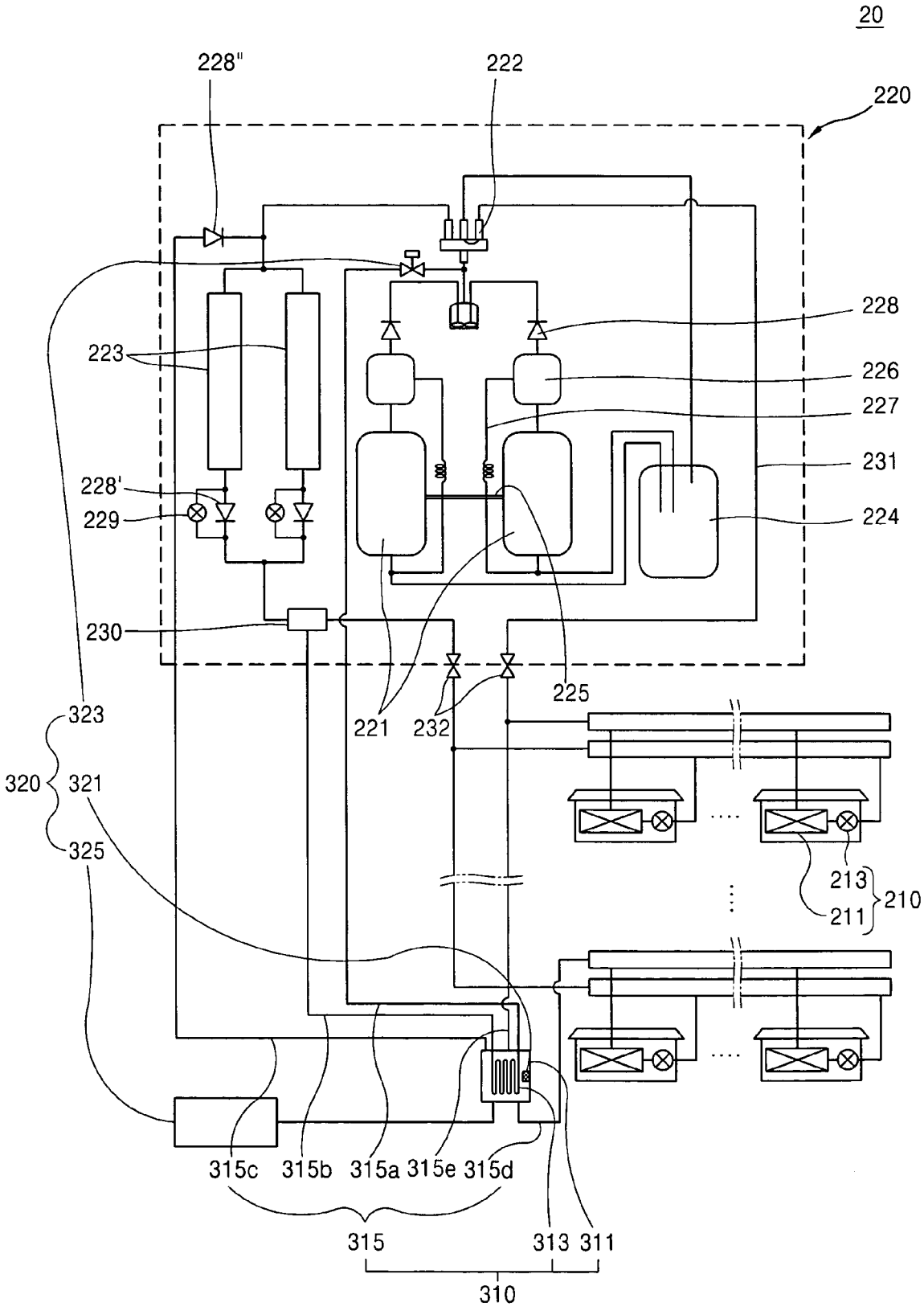
FIG. 2 is a construction view of a multi-type air conditioner in accordance with a first embodiment of the present invention.
Figure 3:
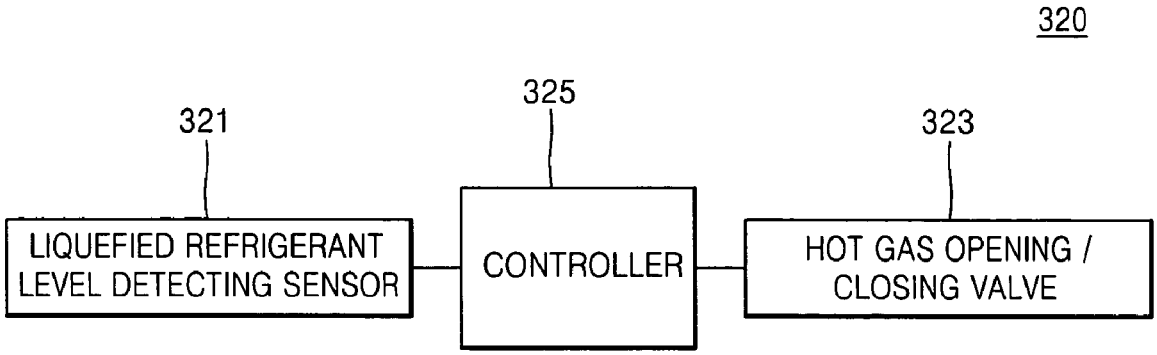
FIG. 3 is a block diagram which illustrates an operation unit of a liquid-stay preventing device of FIG. 2.

FIG. 2 is a construction view of a multi-type air conditioner in accordance with a first embodiment of the present invention, and FIG. 3 is a block diagram which illustrates an operation unit of a liquid-stay preventing device.

As shown in FIG. 2, the multi-type air conditioner 20 includes indoor units 210, an outdoor unit 220, and a liquid-stay preventing device including an evaporation accelerating unit 310 and an operation unit 320 in order to accelerate the evaporation of a liquefied refrigerant flowing from the indoor unit 210.

A plurality of indoor units 210 are disposed in a room, each of which includes an indoor heat exchanger 211 and an indoor expansion unit 213 disposed at one side of the indoor heat exchanger 211.

The outdoor unit 220 includes a plurality of compressors 221 compressing a refrigerant, a four-way valve 222 disposed at a discharge side of the compressor 221 and switching a flow path of the refrigerant, a plurality of outdoor heat exchangers 223 connected to the four-way valve 222, in which the refrigerant undergoes heat exchange, and an accumulator 224 connected to a suction side of each compressor 221 to allow a gaseous refrigerant to be sucked into each compressor 221.

A pair of compressors 221 are connected together by a flow pipe 225 so that oil can flow therebetween, and an oil separator 226 is installed at a discharge side of each compressor 221.

An oil return path 227 is provided at one side of each oil separator 226 in order to allow the separated oil to return to each compressor 221. Also, a first check valve 228 for preventing a back flow of the refrigerant is installed at a discharge side of each oil separator 226.

A second check valve 228' and an outdoor expansion unit 229 are provided at an outlet of each outdoor heat exchanger 223 along a direction that the refrigerant flows at the time of cooling operation, and a receiver 230 is provided at downside of the second check valve 228' and the outdoor expansion unit 229. Service valves are respectively installed at a downside of the receiver 230 and a connection pipe 231 of the indoor unit 210.

The evaporation accelerating unit 310 includes a tank body 311, a heat exchange part 313 and connection pipes 315.

The tank body 311 is a container for temporarily keeping a refrigerant and is disposed at a lower level of a building where a height difference with the outdoor unit 220 is great.

The heat exchange part 313 is installed inside the tank body 313 and evaporates by heating, the liquefied refrigerant accumulated therein. More specifically, the heat exchange part 313 includes a pipe through which a refrigerant discharged from the compressor 221 can flow.

The connection pipes 315 include a first connection pipe 315*a*, a second connection pipe 315*b*, a third connection pipe 315*c*, a fourth connection pipe 315*d* and a fifth connection pipe 315*e*.

The first connection pipe 315*a* connects the heat exchange part 313 to a discharge side of the compressor 221.

The second connection pipe 315*b* connects the heat exchange part 313 to the receiver 230.

The third connection pipe 315*c* connects the heat exchange part 313 to the outdoor heat exchanger 223 to allow the evaporated refrigerant to be introduced to the outdoor heat exchanger 223 along a direction that the refrigerant flows at the time of cooling operation. A check valve 228" is installed on the third connection pipe 315*c* so as to prevent the refrigerant having been discharged from the compressor 221 from being introduced into the tank body 311.

As for the fourth connection pipe 315*d*, its one side is connected to an outlet of the indoor unit 210 along the direction that the refrigerant flows at the time of cooling, and its other side is connected to the tank body 311, so that the refrigerant can be introduced into the tank body 311.

As for the fifth connection pipe 315*e*, its one side is connected to an inlet of the outdoor unit 220, and its other side is connected to the tank body 311, so that the refrigerant within the tank body 311 can flow out.

Referring to FIGS. 2 and 3, the operation unit 320 includes a liquefied refrigerant level detecting sensor 321, a hot gas opening/closing valve 323 and a controller 325.

The liquefied refrigerant level detecting sensor 321 is installed within the tank body 311, detects a level of the liquefied refrigerant and sends a signal to the controller 321 when the level is the same as or higher than a certain level.

The hot gas opening/closing valve 323 is installed on the first connection pipe 315*a*, and is opened or closed so as to allow the refrigerant discharged from the compressor 221 to flow to the heat exchange part 313 or prevent the flowing to the heat exchange part 313.

The controller 325 is implemented as a micom type provided with a control program, and determines and indicates whether to open or close the hot gas opening/closing valve 323 upon receiving a signal of the liquefied refrigerant level detecting sensor 321.

Here, the operation of the liquid-stay preventing device will now be described in accordance with the first embodiment of the present invention.

The liquefied refrigerant level detecting sensor 321 sends a signal to the controller 325 when the level of the liquefied refrigerant within the tank body 311 reaches a set level.

The controller 325 opens the hot gas opening/closing valve 323 upon receiving the signal, thereby allowing the refrigerant having been discharged from the compressor 221 to flow to the heat exchange part 313.

When a high-temperature refrigerant is introduced to the heat exchange part 313, the liquefied refrigerant within the tank body 311 absorbs latent heat and is evaporated. Accordingly, the refrigerant is not accumulated at a low pressure side.

A portion of a gaseous refrigerant within the tank body 311 flows to the accumulator 224 through the first connection pipe 315*e*. The other portion thereof flows along the third connection pipe 315*c*, joins at an inlet side of the outdoor heat exchanger 223, a refrigerant discharged from the compressor 221, and is introduced to the outdoor heat exchanger 223.

The refrigerant having undergone heat-release and condensation in the heat exchange part 313 is introduced into the receiver 230 along the second connection pipe 315*b*, joins the refrigerant having flowed out from the outdoor heat exchanger 233, and flows to the indoor unit 210.

When the level of the liquefied refrigerant is lowered, the controller 325 closes the hot gas opening/closing valve 323 to prevent the refrigerant discharged from the compressor 221 from flowing to the heat exchange part 313.

Figure 4:
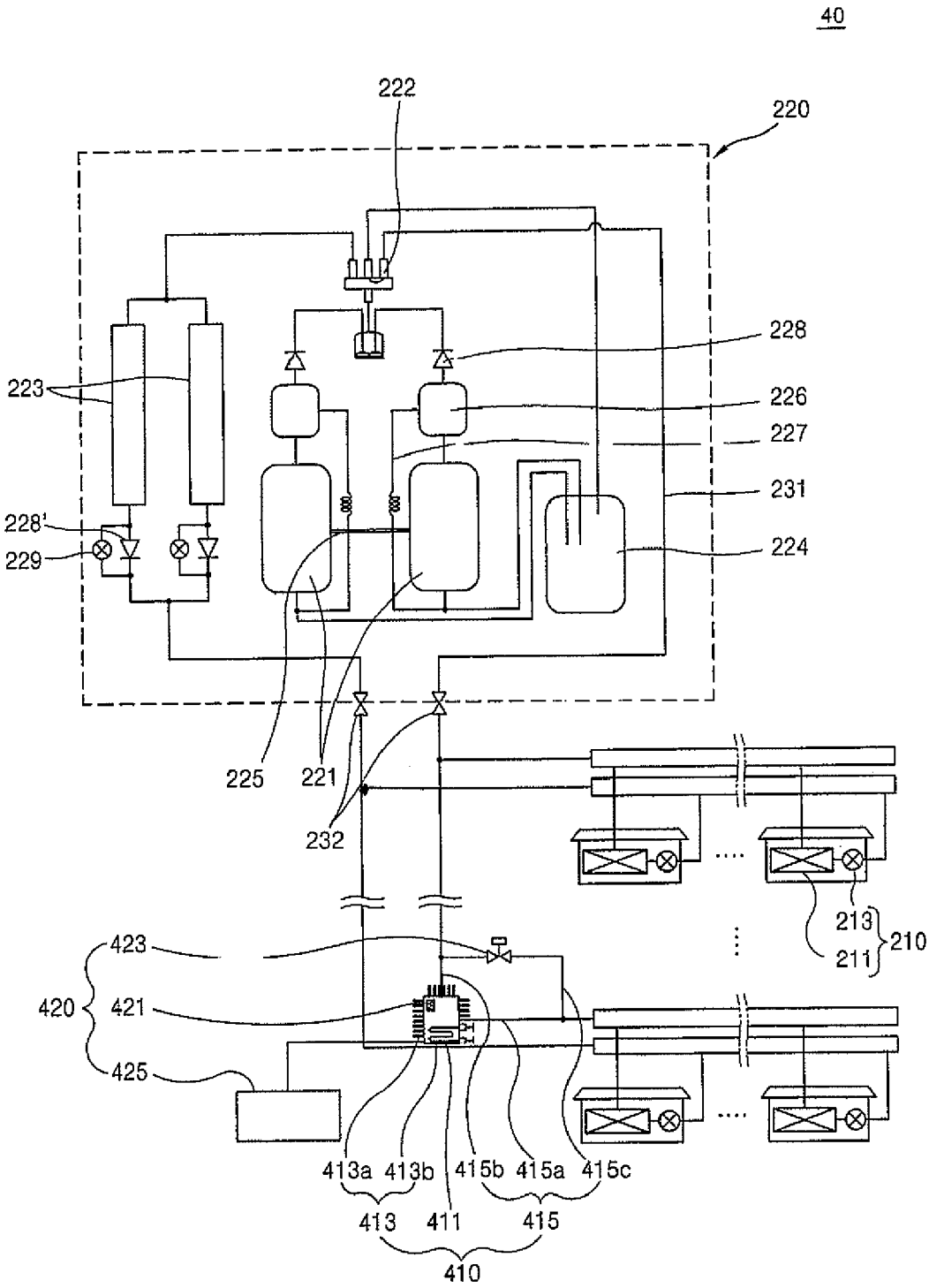
FIG. 4 is a construction view of a multi-type air conditioner in accordance with a second embodiment of the present invention.
Figure 5:
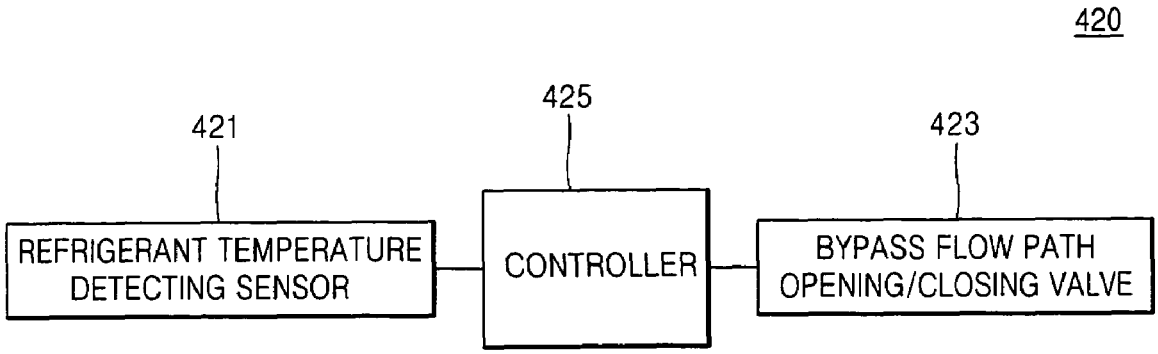
FIG. 5 is a block diagram which illustrates an operation unit of a liquid-stay preventing device of FIG. 4.

A multi-type air conditioner in accordance with the second embodiment of the present invention will now be described with reference to accompanying drawings. FIG. 4 is a construction view of a multi-type air conditioner in accordance with the second embodiment of the present invention, and FIG. 5 is a block diagram which illustrates an operation unit of a liquid-stay preventing device of FIG. 4. For reference, the same reference numerals are designated to the same parts as those of the first embodiment, and the explanation thereon will be omitted.

In FIG. 4, the multi-type air conditioner 40 includes an indoor unit 210, an outdoor unit 220 and a liquid-stay preventing device including an evaporation accelerating unit 410 and an operation unit 420 for accelerating the evaporation of a liquefied refrigerant flowing from the indoor unit.

Description on the construction and operation of the indoor unit 210 and the outdoor unit 220 will be omitted because the description thereon has already been made in describing the first embodiment.

The evaporation accelerating unit 410 includes a tank body 411, a heat exchange part 413 and connection pipes 415.

The tank body 411 is a container for temporarily keeping a refrigerant.

The heat exchange part 413 heats a liquefied refrigerant accumulated in the tank body 311. Unlike the first embodiment in which the heat exchange part includes a pipe, the heat exchange part 413 of the second embodiment includes a heat transfer fin 413*a* and an electric heater 413*b*. Here, the electric heater 413*b* is preferably provided as an auxiliary unit in order to improve heating efficiency. Also, preferably, the heat transfer fin 413*a* and the electric heater 413*b* may be applied to the first embodiment.

The heat transfer fin 413*a* protrudes from an outer surface of the tank body 411 with a maximum sectional area so that the refrigerant within the tank body 411 absorbs exterior latent heat and thusly be evaporated.

The electric heater 413*b* is installed inside the tank body 411 and evaporates the liquefied refrigerant therein by heating.

The connection pipes 415 include an inflow pipe 415*a*, an outflow pipe 415*b* and a bypass flow path 415*c*.

One side of the inflow pipe 415 is connected to an outlet of the indoor unit 210 along a direction that a refrigerant flows at the time of cooling operation, and its other side is connected to the tank body 411, so that the refrigerant can be introduced into the tank body 411.

The outflow pipe 415*b* connects the tank body 411 to an inlet side of the outdoor unit 200 so that the refrigerant within the tank body 411 can flow out.

One side of the bypass flow path 415*c* is connected to the inflow pipe 415*a*, and its other side is connected to the outflow pipe 415*b*, so that the bypass flow path 415*c* allows the refrigerant flowing from the indoor unit 210 to the outdoor unit 220 to bypass the tank body 411.

Referring to FIGS. 4 and 5, the operation unit includes a refrigerant temperature detecting sensor 421, a bypass flow path opening/closing valve 423 and a controller 425.

The refrigerant temperature detecting sensor 421 is installed within the tank body 411, detects a temperature of a refrigerant, and sends a signal to the controller 425 when the detected temperature is the same as or higher than a certain temperature.

The bypass flow path opening/closing valve 423 is installed on the bypass flow path 415*c* and is opened or closed so as to open or close the bypass flow path 415*c*.

The controller 425 is implemented in a micom type provided with a control program, and determines and indicates whether to open or close the bypass flow path opening/closing valve 423 upon receiving a signal of the refrigerant temperature detecting sensor 421.

Here, the operation of the liquid-stay preventing device will now be described in accordance with the second embodiment of the present invention The refrigerant temperature detecting sensor 421 detects a temperature inside the tank body 81 and sends a signal to the controller 425 when the temperature of a refrigerant sucked to a compressor 221 is excessively high.

The controller 425 opens the bypass flow path opening/closing valve 423 to make a refrigerant of the indoor unit 210 flow to the outdoor unit 220 along the bypass flow path 415*c*.

When a temperature at which refrigerant deficiency occurs at a high pressure side of the outdoor unit 220 is detected, the controller 91 closes the bypass flow path opening/closing valve 423. Here, the refrigerant is introduced into the tank body 411 and is evaporated by absorbing latent heat transferred through the heat transfer fin 413*a*. Thus, the refrigerant is not accumulated at a low pressure side.

When a temperature at which a liquefied refrigerant in the tank body 411 is excessively generated due to a relatively-low temperature of the ambient air is detected, the controller 425 operates the electric heater 413*b* to accelerate the evaporation of the liquefied refrigerant.

As described so far, according to the embodiments of the present invention, a liquefied refrigerant is not accumulated in an indoor unit and a connection pipe, which are a low pressure side where the pressure is relatively low, but smoothly passes therethrough regardless of a height difference between the indoor unit and the outdoor unit. Therefore, the efficiency of the multi-type air conditioner is improved.

Also, as the refrigerant deficiency is prevented from occurring at a high pressure side, the reliability of the cooling operation is improved, and the liquefied refrigerant accumulated at the low pressure side is introduced into a compressor of the outdoor unit, thereby preventing damage to the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A multi-type air conditioner comprising:

an outdoor unit;

a plurality of indoor units communicating with the outdoor unit; and a liquid-stay preventing device heating and evaporating a liquefied refrigerant so as to prevent the liquefied refrigerant circulating between the indoor units and the outdoor unit from being accumulated at a low pressure side including the indoor units, wherein the indoor units are installed below the outdoor unit to have a height difference with the outdoor unit, and wherein the liquid-stay preventing device comprises:

an evaporation accelerating unit accelerating evaporation of a liquefied refrigerant flowing from the indoor units; and an operation unit operating the evaporation accelerating unit.

2. The multi-type air conditioner of claim 1, wherein the evaporation accelerating unit comprises:

a tank body;

a heat exchange part installed inside the tank body and heating a liquefied refrigerant accumulated therein in order to evaporate the refrigerant; and a connection pipe connecting the tank body and the heat exchange part to the indoor units and the outdoor unit.

3. The multi-type air conditioner of claim 2, wherein the tank body is disposed at a lower level of a building where a height difference with the outdoor unit is great.

4. The multi-type air conditioner of claim 2, wherein the heat exchange part is a pipe through which the refrigerant discharged from the compressor can flow in order to use heat of the refrigerant.

5. The multi-type air conditioner of claim 2, wherein the outdoor unit comprises:

a compressor, a receiver and an outdoor heat exchanger, and the connection pipes comprise:

a first connection pipe connecting the heat exchange part to a discharge side of the compressor;

a second connection pipe connecting the heat exchange part to the receiver;

a third connection pipe connecting the heat exchange part to the outdoor heat exchanger;

a fourth connection pipe having one side connected to an outlet of the indoor units and the other side connected to the tank body so that a refrigerant can be introduced into the tank body; and a fifth connection pipe having one side connected to an inlet of the outdoor unit and the other side connected to the tank body so that a refrigerant within the tank body can flow out.

6. The multi-type air conditioner of claim 5, wherein a check valve for preventing a refrigerant discharged from the compressor from being introduced is installed on the third connection pipe.

7. The multi-type air conditioner of claim 5, wherein the operation unit comprises:

a liquefied refrigerant level detecting sensor installed inside the tank body, detecting a level of a liquefied refrigerant, and generating a signal; and a hot gas opening/closing valve installed on the first connection pipe and opening or closing the first connection pipe so as to allow a refrigerant to flow to the heat exchange part or prevent the flowing to the heat exchange part; and a controller determining and indicating whether to open or close the hot gas opening/closing valve according to the signal.

8. The multi-type air conditioner of claim 2, wherein the heat exchange part comprises a heat transfer fin protrudingly installed at an outer surface of the tank body.

9. The multi-type air conditioner of claim 2, wherein the heat exchange part further comprises an electric heater installed inside the tank body.

10. The multi-type air conditioner of claim 2, wherein the connection pipes comprise:

an inflow pipe connecting the tank body to the indoor units;

an outflow pipe connecting the tank body to the outdoor unit; and a bypass flow path allowing a refrigerant to flow from the indoor units to the outdoor unit, bypassing the tank body.

11. The multi-type air conditioner of claim 10, wherein one side of the bypass flow path is connected to the inflow pipe, and its other side is connected to the outflow pipe.

12. The multi-type air conditioner of claim 10, wherein the operation unit comprises:

a refrigerant temperature detecting sensor installed inside the tank body, detecting a temperature of a refrigerant and generating a signal;

a bypass flow path opening/closing valve installed on the bypass flow path and opened or closed so as to open or close the bypass flow path; and a controller determining and indicating whether to open or close the bypass flow path opening/closing valve according to the signal.

13. A multi-type air conditioner comprising:

an outdoor unit;

one or more indoor units communicating with the outdoor unit;

an evaporation accelerating unit accelerating evaporation of a liquefied refrigerant flowing from the indoor unit; and an operation unit operating the evaporation accelerating unit, wherein the evaporation accelerating unit comprises:

a tank body;

a heat exchange part installed inside the tank body and heating a liquefied refrigerant accumulated therein in order to evaporate the refrigerant; and a connection pipe connecting the tank body and the heat exchange part to the indoor unit and the outdoor unit, the connection pipe comprising an inflow pipe connecting the tank body to the indoor unit, an outflow pipe connecting the tank body to the outdoor unit, and a bypass flow path allowing a refrigerant to flow from the indoor unit to the outdoor unit, bypassing the tank body.

14. The multi-type air conditioner of claim 13, wherein the operation unit comprises:

a refrigerant temperature detecting sensor installed inside the tank body, detecting a temperature of a refrigerant and generating a signal;

a bypass flow path opening/closing valve installed on the bypass flow path and opened or closed so as to open or close the bypass flow path; and a controller determining and indicating whether to open or close the bypass flow path opening/closing valve according to the signal.

* * * * *